United States Patent [19]

Crisp et al.

[11] 4,375,416

[45] Mar. 1, 1983

[54] DETERGENT COMPOSITION HAVING TEXTILE SOFTENING PROPERTIES

[75] Inventors: Peter N. Crisp, Gateshead; Allan C. McRitchie, Whitley Bay; John G. Bell, Gosforth, all of England

[73] Assignee: The Procter & Gamble Company, Cincinnati, Ohio

[21] Appl. No.: 197,439

[22] Filed: Oct. 16, 1980

Related U.S. Application Data

[63] Continuation of Ser. No. 94,625, Nov. 15, 1979, abandoned.

[30] Foreign Application Priority Data

Nov. 20, 1978 [GB] United Kingdom ..... 45150/78

[51] Int. Cl.[3] ..... C11D 1/40; C11D 1/65; D06M 11/00; D06M 13/34

[52] U.S. Cl. ..... 252/8.7; 252/8.6; 252/8.75; 252/8.8; 252/110; 252/117; 252/131; 252/140; 252/155; 252/174; 252/174.13; 252/174.25; 252/179; 252/525; 252/544

[58] Field of Search ..... 252/8.6, 8.8, 8.75, 252/91, 140, 155, 174, 174.13, 174.25, 179, 525, 544, 8.7, 110, 117, 131

[56] References Cited

U.S. PATENT DOCUMENTS

| | | | |
|---|---|---|---|
| 3,696,056 | 10/1972 | Inamorato | 252/525 |
| 3,709,836 | 1/1973 | Inamorato | 252/525 |
| 3,730,912 | 5/1973 | Inamorato | 252/528 |
| 3,862,058 | 1/1975 | Nirschl | 252/528 |
| 3,886,075 | 5/1975 | Bernardino | 252/8.75 |
| 3,886,098 | 5/1975 | DiSalvo et al. | 252/540 |
| 3,936,537 | 2/1976 | Baskerville | 427/242 |
| 3,959,155 | 5/1976 | Montgomery et al. | 252/8.8 |
| 3,993,573 | 11/1976 | Gloss | 252/8.8 X |
| 4,062,647 | 12/1977 | Storm | 8/137 |
| 4,292,035 | 9/1981 | Battrell | 8/137 |

FOREIGN PATENT DOCUMENTS

| | | | |
|---|---|---|---|
| 1514276 | 6/1978 | United Kingdom . | |
| 1527126 | 10/1978 | United Kingdom | 252/8.8 |

*Primary Examiner*—Dennis L. Albrecht

[57] ABSTRACT

Laundry detergent compositions are provided which contain an effective textile softening agent which does not reduce their cleaning performance. The softening agent comprises a specified class of tertiary amines together with a smectite-type clay.

5 Claims, No Drawings

DETERGENT COMPOSITION HAVING TEXTILE SOFTENING PROPERTIES

This application is a continuation, of application Ser. No. 094,625, filed Nov. 15, 1979, now abandoned.

FIELD OF THE INVENTION

The present inventions relates to detergent compositions which clean well and at the same time act as textile softeners.

BACKGROUND OF THE INVENTION

Numerous attempts have been made to formulate laundry detergent compositions which provide the good cleaning performance expected of them and which also have textile softening properties. Thus, attempts have been made to incorporate cationic textile softeners in anionic surfactant-based built detergent compositions employing various means of overcoming the natural antagonism between the anionic and cationic surfactant species. For instance, in British patent specification 1,518,529, detergent compositions are described comprising organic surfactant, builders, and in particulate form, a quaternary ammonium softener combined with a poorly watersoluble dispersion inhibitor which inhibits premature dispersion of the cationic in the wash liquor. Even in these compositions, some compromise between cleaning and softening effectiveness has to be accepted. Another approach to providing anionic detergent compositions with textile softening ability has been the use of smectite-type clays, as described in British patent specification 1,400,898. These compositions, although they clean well, require rather large contents of clay for effective softening, perhaps because the clay is not very efficiently deposited on the fabrics in the presence of anionic surfactants. Yet another approach to providing built detergent compositions with softening ability has been to employ nonionic surfactants instead of anionic with cationic softeners, and compositions of this type have been described in, for example, British patent specification No. 1,079,388, German Auslegeschrift No. 1,220,956 and U.S. Pat. No. 3,607,763. However, it is found that if enough nonionic surfactant is employed to provide good cleaning, it impairs the softening effect of the cationic softener, so that, once again, a compromise between cleaning and softening effectiveness must be accepted.

The use of clay together with a water insoluble cationic compound and an electrically conductive metal salt as a softening composition adapted for use with anionic, nonionic, zwitterionic and amphoteric surfactants has been described in British patent specification No. 1,483,627. The commonly assigned copending patent application U.S. Ser. No. 962452 filed Nov. 20, 1978, now U.S. Pat. No. 4,292,035, by Charles F. Battrell entitled "Fabric Softening Composition" describes granular textile softening compositions comprising a complex of a cationic softener and a smectite-type clay subsequently treated with an anionic surfactant. These compositions are intended primarily as rinse additives, where their cleaning performance is not of primary interest.

Recently it has been disclosed in British Patent specification No. 1,514,276 that certain tertiary amines with two long chain alkyl or alkenyl groups and one short chain alkyl group are effective fabric softeners in detergent compositions when chosen to have an isoelectric point in the pH range such that they are in nonionic (amine) form in a normal alkaline wash liquor and are more in cationic (salt) form at the lower pH of a rinse liquor, and so become substantive to fabrics. Use of amines of this class, amongst others, in detergent compositions has also been previously disclosed in British patent specification No. 1,286,054.

SUMMARY OF THE INVENTION

It has now been found that the combination of a certain class of tertiary amines and smectite-type clay in an alkaline detergent composition, or employed together with an alkaline detergent composition, provides pronounced textile softening benefits without impairing the cleaning performance of the detergent composition. Cleaning of particulate soil stains is even enhanced. Combinations of clay with cationic textile softeners, or even with other classes of amines, fail to provide both the softening performance of the present compositions and their compatibility with alkaline detergent compositions whereby they have no ill effect upon the cleaning properties. The softening effect is greater than that provided by the amine or the clay alone.

According to the invention there is provided a textile softening detergent composition comprising by weight (a) from 3% to 30% of an organic surfactant, (b) from 1% to 25% of a tertiary amine having the formula

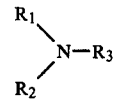

wherein $R_1$ represents a $C_{10}$ to $C_{26}$ alkyl or alkenyl group, $R_2$ represents a group defined as for $R_1$ or a $C_1$ to $C_7$ alkyl group, and $R_3$ represents a $C_1$ to $C_7$ alkyl group, or where $R_1$ is a $C_{16}$–$C_{26}$ alkyl group $R_2$ may be a $C_1$–$C_7$ alkyl group, or a mixture of said amines, (c) from 1.5% to 35% of an impalpable smectite-type clay having an ion exchange capacity of at least 50 meq. per 100 grams, and (d) from 10% to 80% of one or more water soluble inorganic or organic salts such that the pH of a 0.5% by weight aqueous solution of the composition is in the range from 8.5 to 11.

It is preferred that the weight ratio of tertiary amine to clay be in the range from 10:1 to 1:10, preferably from 2:1 to 1:2. Preferably the pH of a 0.5% solution of the composition is in the range from 9.5 to 10.5.

DETAILED DESCRIPTION OF THE INVENTION

Organic Surfactant

Anionic surfactant are much preferred for optimum combined cleaning and textile softening performance, but other classes of organic surfactants and mixtures thereof may be used, including surfactants such as the ethoxylated fatty alcohols and alkyl phenols well known in the art, amphoteric and zwitterionic surfactants and mixtures thereof as disclosed in U.S. Pat. No. 3,929,678, the disclosures of which are hereby incorporated by reference. When anionic surfactants are employed, it is preferred that nonionic and other classes of surfactant be absent but, if mixtures containing anionics are used, it is preferred that the anionic forms the major part of the mixture.

Suitable anionic non-soap surfactants are water soluble salts of alkyl benzene sulfonates, alkyl sulfates, alkyl polyethoxy ether sulfates, paraffin sulfonates, alphaolefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonates, and beta-alkyloxy alkane sulfonates. Soaps are also suitable anionic surfactants.

Especially preferred alkyl benzene sulfonates have about 9 to about 15 carbon atoms in a linear or branched alkyl chain, more especially about 11 to about 13 carbon atoms. Suitable alkyl sulfates have about 10 to about 22 carbon atoms in the alkyl chain, more especially from about 12 to about 18 carbon atoms. Suitable alkyl polyethoxy ether sulfates have about 10 to about 18 carbon atoms in the alkyl chain and have an average of about 1 to about 12 —$CH_2CH_2O$— groups per molecule, especially about 10 to about 16 carbon atoms in the alkyl chain and an average of about 1 to about 6 —$CH_2CH_2O$— groups per molecule.

Suitable paraffin sulfonates are essentially linear and contain from about 8 to about 24 carbon atoms, more especially from about 14 to about 18 carbon atoms. Suitable alpha-olefin sulfonates have about 10 to about 24 carbon atoms, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Suitable alpha-sulfocarboxylates contain from about 6 to about 20 carbon atoms; included herein are not only the salts of alpha-sulfonated fatty acids but also their esters made from alcohols containing about 1 to about 14 carbon atoms.

Suitable alkyl glyceryl ether sulfates are ethers of alcohols having about 10 to about 18 carbon atoms, more especially those derived from coconut oil and tallow. Suitable alkyl phenol polyethoxy ether sulfates have about 8 to about 12 carbon atoms in the alkyl chain and an average of about 1 to about 6—$CH_2CH_2O$— groups per molecule. Suitable 2-acyloxy-alkane-1-sulfonates contain from about 2 to about 9 carbon atoms in the acyl group and about 9 to about 23 carbon atoms in the alkane moiety. Suitable beta-alkyloxy alkane sulfonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanolammonium cations; sodium is preferred. Mixtures of anionic surfactants are contemplated by this invention; a satisfactory mixture contains alkyl benzene sulfonate having 11 to 13 carbon atoms in the alkyl group and alkyl sulfate having 12 to 18 carbon atoms in the alkyl group.

Suitable soaps contain about 8 to about 24 carbon atoms, more especially about 12 to about 18 carbon atoms. Soaps can be made by direct saponification of natural fats and oils such as coconut oil, tallow and fish oil, or by the neutralization of free fatty acids obtained from either natural or synthetic sources. The soap cation can be alkali metal, ammonium or alkanolammonium; sodium is preferred.

The compositions contain from 3 to 30% of organic detergent, preferably from 5 to 20% of anionic detergent.

THE TERTIARY AMINES

Suitable amines are highly water insoluble amines of the structural formula

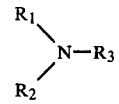

wherein $R_1$ and $R_2$ are independently selected from $C_{10}$–$C_{26}$ alkyl alkyl and alkenyl groups and $R_3$ is a $C_1$–$C_7$ alkyl group. Preferably $R_1$ and $R_2$ each independently represents a $C_{12}$–$C_{22}$ alkyl group, preferably straight chained, and $R_3$ is methyl, or ethyl. Suitable amines include Di decyl methylamine
di lauryl methylamine
di myristyl methylamine
di cetyl methylamine
di stearyl methylamine
di arachadyl methylamine
di behenyl methylamine
arachadyl behenyl methylamine or
di(mixed arachidyl/behenyl) methylamine
di (tallowyl) methylamine
arachidyl/behenyl dimethylamine and the corresponding ethyl amines, propylamines and butyl amines. Especially preferred is ditallowyl methylamine. This is commercially available as Kemamine T9701 (Humko Trade Name)

Other commercially available amines are Kemamine T1901 ($DiC_{20/22}$ alkyl methylamine) and Kemamine T6501 (dicoconut methylamine).

The compositions contain from 1% to 25% usualy from about 2% to about 15% by weight of the tertiary amine, especially from about 4% to about 8%.

THE CLAY

The smectite clays particularly useful in the practice of the present invention are sodium and calcium montmorillonites, sodium saponites, and sodium hectorites. The clays used herein have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., alumino-silicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0. Of these only montmorillonites having exchange capacities greater than 50 meq/100 g. are suitable for the present invention and provide fabric softening benefits.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)$ $(Mg_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0. Hectorite and saponite are the only minerals in this class that are of value in the present invention, the fabric softening performance being related to the type of exchangeable cation as well as to the exchange capacity. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure.

As noted hereinabove, the clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation:

$$\text{Smectite clay (Na)} + \rightleftarrows \text{smectite clay } (NH_4) + NaOH$$

Since in the foregoing equilibrium reaction one equivalent weight of ammonium ion replaces an equivalent weight of sodium, it is customary to measure cation exchange capacity (sometimes termed "base exchange capacity") in terms of milli-equivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain smectite clays. Illite clays although having a three layer structure, are of an non-expanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydrolys containing Al and Mg atoms.

It has been determined that illite, attapulgite, and kaolinite clays, with their relatively low ion exchange capacities, are not useful in the present compositions. However the alkali metal montmorillonites, saponites, and hectorites, and certain alkaline earth metal varieties of these minerals such as calcium montmorillonites have been found to show useful fabric softening benefits when incorporated in the compositions in accordance with the present invention.

Specific non-limiting examples of such fabric softening smectite clay minerals are:

| |
|---|
| Sodium Montmorillonite |
| Brock |
| Volclay BC |
| Gelwhite GP |
| Thixo-Jel # |
| Ben-A-Gel |
| Sodium Hectorite |
| Veegum F |
| Laponite SP |
| Sodium Saponite |
| Barasym NAS 100 |
| Calcium Montmorillonite |
| Soft Clark |
| Gelwhite L |
| Imvite K |
| Lithium Hectorite |
| Barasym LIH 200 |

Accordingly, smectite clays useful herein can be characterised as montmorillonite, hectorites, and saponite clay minerals having an ion exchange capacity of at least about 50 meq/100 g. and preferably at least 60 meq/100 g. Most of the smectite clays useful in the compositions herein are commercially available under various Trade Names for example Thixogel No. 1 and Gelwhite GP from Georgia Kaolin Co., Elizabeth, N.J.; Imvite K from Industrial Mineral Ventures; Volclay BC and Volclay #325, from American Colloid Co., Skokie Ill.; and Veegum F, from R. T. Vanderbilt. It is to be recognised that such smectite minerals obtained under the foregoing Trade Names can comprise mixtures of the various discrete mineral entities. Such mixtures of the smectite minerals are suitable for use herein.

Within the classes of montmorillonite, hectorite and saponite clay minerals having a cation exchange capacity of at least about 50 meq/100 g, certain clays are preferred for fabric softening purposes. For example, Gelwhite GP is an extremely white form of smectite clay and is therefore preferred when formulating white granuler detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in detergent softening compostions. Imvite K is also very satisfactory.

Appropriate clay minerals for use herein can be selected by virtue of the fact that smectites exhibit a true 14 A x-ray diffraction pattern. This characteristic pattern, taken in combination with exchnge capacity measurements performed in the manner noted above, provides a basis for selecting particular smectite-type minerals for use in the compositions disclosed herein.

The smectite clay materials useful in the present invention are hydrophilic in nature, i.e. they display swelling characteristics in aqueous media. Conversely they do not swell in nonaqueous or predominantly nonaqueous systems.

The compositions contain from 1.5% to 35%, preferably from about 4% to about 15% of said smectite-type clay, especially from about 5–12%.

WATER-SOLUBLE SALTS

The compositions of the invention contain from 10% to 80% of water soluble salts, preferably from 20% to 70%, and most usually from 30% to 60%, and these may be any which are such that the detergent composition in a 0.5% by weight aqueous solution has pH in the specified range, that is from 8.5 to 11, preferably from 9.5 to 10.5. At this pH the tertiary amines of the invention are in nonionic (amine) form and are therefore compatible with anionic surfactants.

Preferably the water soluble salts are detergency builders and these can be of the polyvalent inorganic and polyvalent organic types, or mixtures thereof. Nonlimiting examples of suitable water-soluble, inorganic alkaline detergent builder salts include the alkali metal carbonates, borates, phosphates, polyphosphates, tripolyphosphates, bicarbonates, and silicates. Specific examples of such salts include the sodium and potassium tetraborates, bicarbonates, carbonates, tripolyphosphates, pyrophosphates, pentapolyphosphates and hexametaphosphates. Sulphates are usually also present.

Examples of suitable organic alkaline detergency builders salts are:

(1) water-soluble amino polyacetates, e.g., sodium and potassium ethylenediaminetetraacetates, nitrilotriacetates, N-(2-hydroxyethyl) nitrilodiacetates and diethylenetriamine pentaacetates;

(2) water-soluble salts of phytic acid, e.g. sodium and potassium phytates;

(3) water-soluble polyphosphonates, including sodium, potassium and lithium salts of methylenediphosphonic acid and the like and aminopolymethylene phosphonates such as ethyldiaminetetramethylenephosphonate and diethylenetriaminepentamethylene phosphonate, and polyphosphonates as described in the commonly assigned German Application DOS 2816770, the disclosures of which are hereby incorporated herein by reference.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2-2-ethane tetracarboxylic acid, cyclopentanecis, cis, cis-tetracarboxylic acid, mellitic acid and pyromellitic acid.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprises a water-insoluble material capable of forming a water-insoluble reaction production with water hardness cations preferably in combination with a crystallization seed which is capable of providing growth sites for said reaction product. Such "seeded builder" compositions are fully disclosed in British Patent Specification No. 1,424,406.

Preferred water soluble builders are sodium tripolyphosphate and sodium silicate, and usually both are present. In particular it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, particularly those described in Belgian Pat. No. 814,874, issued Nov. 12, 1974 incorporated herein by reference. This patent discloses and claims detergent compositions containing sodium aluminosilicates of the formula $$Na_z(AlO_2)_z(SiO_2)_y xH_2O$$

wherein Z and Y are integers equal to at least 6, the molar ratio of Z to Y is in the range of from 1.0:1 to about 0.5:1 and x is an integer from about 15 to about 264. A preferred material is $Na_{12}(SiO_2AlO_2)_{12}27H_2O$.

Preferably, the compositions contain from 20% to 70% of builders, more usually 30% to 60% by weight. If present, incorporation of about 5% to about 25% by weight of aluminosilicate is suitable, partially replacing water soluble builder salts, provided that sufficient water soluble alkaline salts remain to provide the specified pH of the composition in aqueous solution.

OPTIONAL COMPONENTS

The optional components usual in built laundry detergents may of course be present. These include bleaching agents such as sodium perborate, sodium percarbonate and other perhydrates, at levels from about 5% to 35% by weight of the composition, and activators therefor, such as tetra acetyl ethylene diamine, tetra acetyl glycouril and others known in the art, and stabilisers therefor, such as magnesium silicate, and ethylene diamine tetra acetate.

Suds controlling agents are often present. These include suds boosting or suds stabilising agents such as mono- or di-ethanolamides of fatty acids. More often in modern detergent compositions, suds suppressing agents are required. Soaps especially those having 16–22 carbon atoms, or the corresponding fatty acis, can act as effective suds suppressors if included in the anionic surfactant component of the present compositions. Usually about 1% to about 4% of such soap is effective as a suds suppressor. Very suitable soaps when suds suppression is a primary reason for their use, are those derived from Hyfac (Trade name for hardened marine oil fatty acids predominantly $C_{18}$ to $C_{20}$).

However, non-soap suds suppressors are preferred in synthetic detergent based compositions of the invention since soap or fatty acid tends to give rise to a characteristic odour in these compositions.

Preferred suds suppressors comprise silicones. In particular there may be employed a particulate suds suppressor comprising silicone and silanted silica releasably enclosed in water soluble or dispersible substantially non-surface active detergent impermeable carrier. Suds suppressing agent of this sort are disclosed in British patent specification No. 1,407,997. A very suitable granular (prilled) suds suppressing product comprises 7% silica/silicone (85% by weight silanated silica, 15% silicone, obtained from Messrs. Dow Corning), 65% sodium tripolyphosphate, 25% Tallow alcohol condensed with 25 molar proportions of ethylene oxide, and 3% moisture. The amount of silica/silicone suds suppressor employed depends upon the degree of suds suppression desired but is often in the range from 0.01% to 0.5% by weight of the detergent composition. Other suds suppressors which may be used are water insoluble preferably microcrystalline, waxes having melting point in the range from 35° to 125° C. and saponification value less than 100, as described in British patent specification No. 1,492,938.

Yet other suitable suds suppressing systems are mixtures of hydrocarbon oil, a hydrocarbon wax and hydrophobic silica as described in European laid open patent application No. 0000216 published Jan. 10, 1979 and, especially, particulate suds suppressing compositions comprising such mixtures, combined with a nonionic ethoxylate having hydrophilic lipophilic balance in the range from 14–19 and a compatibilising agent capable of forming inclusive compounds, such as urea. These particulate suds suppressing compositions are described in European patent application No. 79200472.3 filed Aug. 29, 1979.

Soil suspending agents are usually present at about 0.1 to 10%, such as water soluble salts of carboxymethylcellulose, carboxyhydroxymethyl cellulose, polyethylene glycols of molecular weight from about 400 to 10000 and copolymers of methylvinylether and maleic anhydride or acid, available from the General Aniline and Film Corporation under the Trade Name Gantrez.

Proteolytic, amylolytic or lipolytic enzymes, especially proteolytic, and optical brighteners, of anionic cationic or nonionic types, especially the derivatives of sulphonated triazinyl diamino stilbene may be present. A further useful additive is a photo activated bleach comprising a mixture of the tri and tetra sulphonated derivatives of zinc phthalocyanine as described in B.P. Specification Nos. 1372035 and 1408144.

Through the description herein, where sodium salts have been referred to potassium, lithium or ammonium or amine salts may be used instead if their extra cost etc. are justified for special reasons.

PREPARATION OF THE COMPOSITIONS

The detergent compositions may be prepared in any way, as appropriate to their physical form, as by mixing the components, co-agglomerating them or dispersing them in a liquid carrier. Preferably the compositions are granular and are prepared by spray drying an aqueous slurry of the non-heat-sensitive components to form spray dried granules into which may be admixed the heat sensitive components such as persalts, enzymes, perfumes etc. Although the amine may be included in the slurry for spray drying, it is preferred that it be incorporated by being sprayed in liquid form on the spray dried granules before or after other heat sensitive solids have been dry mixed with them. Although the amine is generally a waxy solid of rather low melting point the granules so made are surprisingly crisp and free-flowing. Alternatively the amine in liquid form may be sprayed onto any particulate component or components of the composition which are able to act as carrier granules. The clay component may be added to the slurry for spray drying or may be dry mixed, as preferred for reasons unrelated to its softening effect, such as for optimum colour of the product.

EXAMPLES 1 AND 2

Textile softening detergent compositions were prepared having the formula, in parts percent by weight:

| EXAMPLE | 1 | 2 |
|---|---|---|
| (a) Sodium linear dodecylbenzene sulphonate (LAS) | 8 | 8 |
| (a) Sodium tripolyphosphate | 32 | 30 |
| (a) Sodium silicate (ratio $SiO_2/NaO2$) | 6 | 6 |
| (a) Sodium sulphate | 5 | 5 |
| (c) Sodium perborate | 25 | 22 |
| (a) Sodium carboxymethyl cellulose | 0.8 | 0.8 |
| (a) Sodium ethylenediamine tetra acetate | 0.2 | 0.2 |
| (c) Enzyme granules | 0.4 | 0.4 |
| (a) Optical brightener | 0.2 | 0.2 |
| (b) Perfume | 0.25 | 0.25 |
| (c) Silica-silicone suds suppressor* | 0.15 | 0.15 |
| (a) Clay **(montmorillonite) | 10 | 10 |
| (b) Ditallowyl methylamine | 6 | 12 |
| — Moisture etc. | 6 | 5 |

*Silica-polydimethyl siloxane in ratio by weight 90:10
**"Imvite K - Tradename of Messrs. Industrial Mineral Ventures (I.M.V.).

The compositions were prepared by making spray dried granules containing components (a), spraying molten ditallowylmethylamine and perfume (components (b)) on to them in a rotating drum, and dry mixing the resultant granules with components (c). 0.5% solutions of the compositions in water at 20° C. had pH 8.9 to 10.1.

These compositions had as good cleaning performance as the same compositions lacking the clay and amine, with slightly better cleaning performance on clay soiling. Cotton test pieces washed with these compositions were softer in feel than similar test pieces washed with the same detergent compositions excluding either the amine or the clay or both.

Furthermore it was found that the softening effect provided by the clay was greater when the clay was added to the amine containing detergent composition of Example 1 than when it was added to the detergent composition of Example 1 lacking amine.

Similar performance is obtained when the tertiary amine is replaced by dicoconut methylamine, di-myristyl methylamine, ditallowyl ethylamine, di(arachidyl behenyl) methylamine, ditallowyl propylamine, or tallow dimethylamine.

Similar performance is obtained when the "Imvite K" clay is replaced by Volclay BC, Gelwhite GP, Soft Clark, or Gelwhite L. Volclay is a tradename of American Colloids Co., Gelwhite and Soft Clark are Tradenames of Georgia Kaolin Co.

Similar performance is obtained when the LAS is replaced by a mixture of 4% LAS and 4% sodium coconut alkyl sulphate, or a mixture of 5% LAS and 3% sodium tallow alkyl sulphate.

Similar performance was obtained when the clay was dry mixed, together with components (c) instead of being added to the slurry for spray drying.

EXAMPLES 3 TO 7

The following compositions are prepared substantially as described in Example 1, and provide cleaning and textile softening benefits. Quantities are in parts percent by weight.

| Example | 3 | 4 | 5 | 6 | 7 |
|---|---|---|---|---|---|
| Sodium linear dodecyl benzene sulphonate. | 15 | 5 | 8 | 10 | — |
| Sodium tallow alkyl sulphate | — | 5 | — | — | — |
| Sodium soap (80/20 Tallow-coconut) | — | 3 | — | — | 45 |

-continued

| Example | 3 | 4 | 5 | 6 | 7 |
|---|---|---|---|---|---|
| Sodium tripolyphosphate | 30 | 44 | 12 | 5 | 5 |
| Sodium carbonate | 4 | — | — | 14 | 20 |
| Sodium silicate | 8 | 6 | 10 | 8 | 10 |
| Sodium sulphate | 12 | 8 | 6 | 8 | — |
| Sodium perborate tetrahydrate | 7 | 10 | 20 | — | — |
| Sodium alumino silicate | — | — | 20 | — | — |
| Sodium carboxymethyl cellulose | 1 | 1 | 1 | 1 | — |
| Sodium ethylenediamine tetra acetate | 0.2 | 0.2 | 0.2 | — | — |
| Enzyme granules | 0.5 | 0.5 | 0.5 | — | — |
| Optical brightener | 0.3 | 0.3 | 0.3 | — | 0.3 |
| Clay (Imvite K) | 4 | 8 | 10 | 30 | 3 |
| Ditallow methylamine | 10 | 2 | 6 | 20 | 4 |
| Moisture etc. | 8 | 7 | 6 | 4 | 12.7 |

What is claimed is:

1. A textile softening composition consisting essentially of, by weight, (a) from about 5% to about 20% of anionic organic surfactant;

(b) from about 2% to about 8% of tertiary amine having the formula $R_1R_2R_3N$ wherein $R_1$ and $R_2$ are independently selected from $C_{10}$ to $C_{26}$ alkyl and alkenyl groups, and $R_3$ represents a $C_1$ to $C_7$ alkyl group;

(c) from about 1.5% to about 12% of impalpable smectite-type clay having an ion exchange capacity of at least about 50 meq per 100 grams; and (d) from about 20% to about 60% of one or more water-soluble detergency builder salts; wherein the weight ratio of tertiary amine to smectite-type clay is in the range from about 2:1 to 1:2 and wherein the pH of a 0.5% by weight aqueous solution of the composition is in the range from 8.5 to 11.0; wherein the amine component (b) is disposed on the surface of granules comprising components (a), (c), and (d).

2. A textile softening composition consisting essentially of, by weight, (a) from about 5% to about 20% of anionic organic surfactant;

(b) from about 2% to about 8% of tertiary amine having the formula $R_1R_2R_3N$ wherein $R_1$ and $R_2$ are independently selected from $C_{10}$ to $C_{26}$ alkyl and alkenyl groups, and $R_3$ represents a $C_1$ to $C_7$ alkyl group;

(c) from about 4% to about 12% of impalable smectite-type clay having an ion exchange capacity of at least about 50 meq per 100 grams; and (d) from about 20% to about 60% of one or more water-soluble detergency builder salts; wherein the weight ratio of tertiary amine to smectite-type clay is in the range from about 2:1 to 1:2 and wherein the pH of a 0.5% by weight aqueous solution of the composition is in the range from 8.5 to 11.0; wherein the amine component (b) is disposed on the surface of granules comprising components (a), (c), and (d).

3. A textile softening composition as recited in claim 2, wherein said amine is present in an amount ranging from about 4% to about 8% and has the formula $R_1R_2R_3N$ wherein $R_1$ and $R_2$ are independently selected from $C_{12}$–$C_{22}$ alkyl groups and $R_3$ is methyl, and wherein said clay is present in an amount ranging from about 5% to about 12%.

4. A textile softening composition as recited in claim 3, wherein said amine is ditallow methyl amine.

5. A textile softening composition as recited in claim 4, wherein said anionic organic surfactant comprises alkylbenzene sulfonate having about 9 to about 15 carbon atoms in the alkyl group and wherein said clay is montmorillonite clay and wherein said builder salt comprises sodium tripolyphosphate.

* * * * *